United States Patent [19]

Carlsen

[11] 4,069,986

[45] Jan. 24, 1978

[54] FLYING TRANSFER WINDER DRIVE

[75] Inventor: Richard A. Carlsen, Somerset, N.J.

[73] Assignee: Egan Machinery Company, Somerville, N.J.

[21] Appl. No.: 737,999

[22] Filed: Nov. 2, 1976

[51] Int. Cl.[2] ..... B65H 19/26; B65H 19/28

[52] U.S. Cl. ..... 242/56 A; 242/64

[58] Field of Search ..... 242/56 A, 64, 56 R, 242/58, 75.51, 75.5

[56] References Cited

U.S. PATENT DOCUMENTS

| | | | |
|---|---|---|---|
| 2,586,832 | 2/1952 | Kohler | 242/56 A |
| 2,718,362 | 9/1955 | Piperoux et al. | 242/56 A |
| 2,943,806 | 7/1960 | Phelps | 242/56 A |
| 3,635,415 | 1/1972 | Phelps et al. | 242/64 |

*Primary Examiner*—George F. Mautz
*Attorney, Agent, or Firm*—David A. Verner

[57] ABSTRACT

A drive for a flying transfer winder wherein a continuously traveling web is transferred from a fully wound roll to a new core. A single winder drive motor is selectively connected to the winding cores and the motor speed is controlled by a dancer roll upstream of the winder. An auxiliary drive is provided to bring up the peripheral speed of the new core at the time of transfer to a speed which is somewhat less than the web speed. Drive means, including overrunning clutches, are provided in the winder drive and auxiliary drive to allow a smooth and controllable movement of the dancer roll during transfer of the web and transfer of control to the winder drive motor.

7 Claims, 1 Drawing Figure

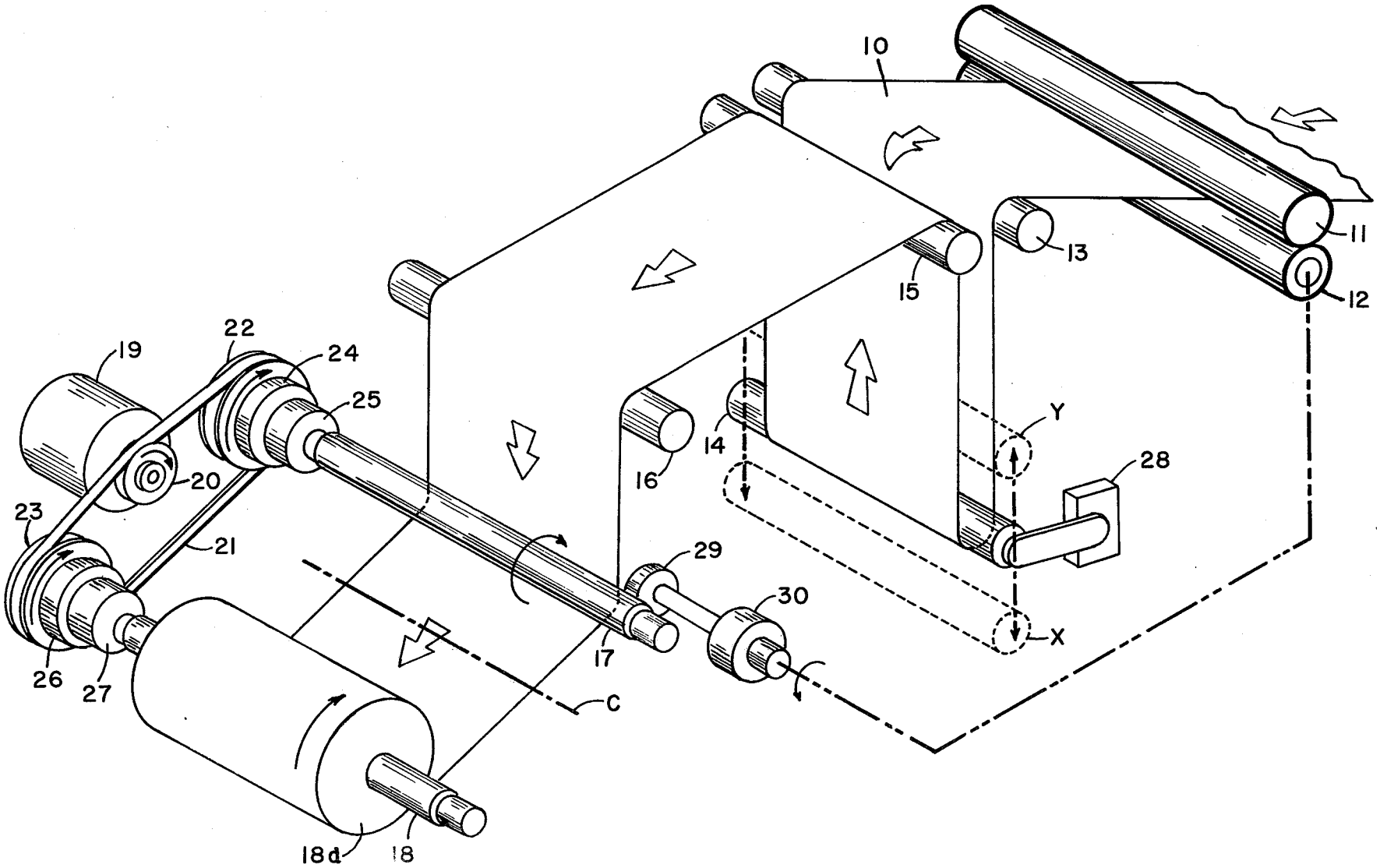
10
11
12
13
14
15
16
17
18
18d
19
20
21
22
23
24
25
26
27
28
29
30
X
Y
C

FLYING TRANSFER WINDER DRIVE

BACKGROUND OF THE INVENTION

This invention relates to improvements in the continuous winding of flexible web materials and in particular to an improved apparatus and method for driving the cores on which the material is wound in a flying transfer winder wherein the web is transferred from a fully wound roll to a new core without stopping the flow of the material being wound. The invention is applicable to winders wherein the core driving means are controlled by a dancer roll system upstream of the winder, such means being well known in the art as exemplified in U.S. Pat. Nos. 2,509,250 to Roberts, 2,237,112 to Parvin, 2,886,257 to Hill, 3,650,490 to Saunders and many others.

The term "flying transfer winder" as used herein includes those winders in which the traveling web is transferred from the fully wound roll to a new core without stopping the flow of the web material being wound. The preferred embodiment includes a mechanical transfer device which severs the moving web and starts the leading edge on the new core, with or without the use of adhesive. Such devices are well known and of various types, typical of which are those disclosed in Meihofer U.S. Pat. No. 3,383,062, Phelps U.S. Pat. No. 2,943,806 and Kohler U.S. Pat. No. 2,586,832. In addition the term "flying transfer winder" as used herein includes those winders wherein the transfer is accomplished manually by the winder operator severing the web with a knife or other severing means and manually starting the leading edge of the web on the new core.

One of the requirements associated with flying transfer winders is that speed and torque delivered to the new core immediately before, during, and immediately after the transfer of the web to the new core be precisely regulated in order that the transfer be positive and that the tension in the web is maintained substantially constant throughout the transfer. It will be appreciated that at the moment of transfer the core on which the completed roll is winding is turning slowly because of the large roll diameter relative to the rotational speed of the small diameter new core required to substantially match the linear speed of the web.

Piperoux U.S. Pat. No. 2,718,362 discloses a flying transfer winder wherein the core drives are controlled by a dancer roll system and wherein two independent drive motors are used, each motor driving an associated core. By this means it is possible to bring the new core up to or slightly below the linear speed of the web before the transfer is made so that upon transfer and switching of the dancer roll control to the new core there is a minimum of disturbance to the web tension. Meihofer U.S. Pat. NO. 3,383,062 is similar with the addition of overrunning clutches in the core drives to improve the operation.

Due to the characteristics of the winding process, wherein the drive motor must provide low torque at high speed at the start of winding and high torque at low speed at the finish when the wound roll is full in order to maintain the desired web tension, the winding motors are costly and it therefore would be desirable to provide a flying transfer winder which operates with only one dancer controlled winder drive motor.

Kohler U.S. Pat. No. 2,586,832 discloses a flying transfer winder wherein only one winder drive motor is required and where an auxiliary drive is used to import rotation to the new core before transfer; this rotational speed being somewhat above the speed of the web. This method is satisfactory, as is stated in the patent when the motor accelerates very rapidly to its full speed with the removal of the load. However, this will not occur when the winder drive motor is controlled by a dancer roll since at the instant of transfer, the dancer roll is in a position calling for slow speed of the winder drive motor. The motor will therefore not accelerate until the dancer roll moves to a new position calling for high motor speed. This movement will not occur using the method of Kohler since the new core is driven faster than the web and after transfer the web speed will increase, moving the dancer roll in the direction of calling for a slower speed of the motor, rather than higher speed.

Phelps U.S. Pat. No. 2,943,806 provides an auxiliary drive which brings the new core up to match the web speed. In a dancer roll controlled system this would result in the dancer roll maintaining its position calling for slow speed of the winder drive motor.

SUMMARY OF THE INVENTION

The present invention provides, in a flying transfer winder having at least two winding positions, a single motor adapted to be selectively connected to the winding cores and the motor speed controlled by a dancer roll upstream of the winder. An auxiliary drive is provided to bring up the new core to a speed which is somewhat less than the web speed at the time of transfer which will result in a smooth repositioning of the dancer roll in order to accelerate the winder drive motor as will be more fully explained below.

OBJECTS OF THE INVENTION

It is the principal object of this invention to provide improvements to a flying transfer winder having a dancer roll control of the winder drive means wherein only a single winder drive motor is required to drive two or more winding cores.

A second object is to provide the aforementioned improvements wherein the movement of the dancer roll is performed smoothly and controllably during the transfer sequence.

DRAWING

The FIGURE is a partially isometric and partially schematic view of a web winder and associated equipment embodying the present invention. Only those parts of the equipment necessary to understand the invention are shown. It is understood that the components shown are suitably mounted on frames or supports. Such frames or supports are well known in the art and are omitted herein for the sake of clarity and simplicity.

DESCRIPTION OF PREFERRED EMBODIMENT

Referring to the FIGURE, the web of material 10 enters continuously from a supply source such as a previous processing machine and travels continuously in the direction of the arrows. Driven pull rolls 11 and 12 pull the web from the supply source and forward it in the direction of the winder. These rolls have a positive grip on the web so that the web speed corresponds to the rotational speed of the pull rolls at all times.

The web passes over idler roll 13, under dancer roll 14 and over idler roll 15. Dancer roll 14 is mounted so as to be supported by the web and freely movable in the vertical direction from a lower position denoted "X" to an upper position denoted "Y". The web then travels over idler roll 16, under the new core 17 and is wound up on core 18 as winding roll 18*a*. Cores 17 and 18 are rotatably mounted in a conventional turret type winder as shown, for example: in the aforementioned Kohler and Phelps patents, wherein the turret arms holding the cores may be indexed around a center "C" so as to transpose the core positions to accomplish the transfers.

The cores are driven by winder drive motor 19 through motor pulley 20, belt or chain 21 and core pulleys 22 and 23. Between the core pulley 22 and the core 17 is on-off clutch 24 and overrunning clutch 25 and similarly between the core pulley 23 and core 18 is on-off clutch 26 and overrunning clutch 27. The overrunning clutches 25 and 27 are so arranged that the respective cores may be positively driven by the motor 19 in the winding direction (clockwise as shown in the drawing) and that the cores may be driven freely by other means at a greater rotational speed in the same direction. The speed of the drive motor 19 is controlled by a regulator 28 actuated by movement of the dancer roll so that, as shown in the drawing embodiment, a lower vertical position of the dancer roll (in the vicinity of "X") corresponds to a high speed of the winder drive motor 19 and movement of the dancer roll vertically upward toward "Y" will result in slowing down the motor. This type of winder motor control is well known and may be accomplished by various conventional types of regulators and other devices.

Mounted on the winder frame and adjacent to new core 17 when the core is in the position for making a transfer is auxiliary drive wheel 29, which is so mounted that it may be brought into or taken out of contact with a core when the core is in the transfer position. The auxiliary drive wheel is driven through an auxiliary drive overrunning clutch 30 from a drive connection to the driven pull roll 12 and the overrunning clutch is so arranged that the wheel 29 is positively driven in the counterclockwise direction as shown in the drawing and the wheel may be freely driven by the core 17 in the same direction at a greater speed. The drive ratio between the pull roll 12 and the auxiliary drive wheel 29 and the core 17 is such that when the wheel is in contact with the core the core will be driven by frictional contact at a peripheral speed slightly below the corresponding web speed leaving the pull rolls 11 and 12.

In normal operation the web 10 will pass directly from idler 16 to winding core 18, the turret arms being indexed to a position wherein new core 17 is out of contact with the web. The core 18 is driven by the motor 19 through the on-off clutch 26, which is in the engaged position, and the overrunning clutch 27. The on-off clutch 24 is in the disengaged position so that new core 17 is not driven at this time. The speed of the winding motor is controlled by the position of the dancer roll acting through the regulator 28. Assuming, for the moment, that the winding roll 18*a* on core 18 does not increase in diameter as winding continues, the motor will run at a speed corresponding to the web speed leaving the pull rolls 11 and 12. If for some reason the speed of the winding motor increases, the tension in the web between the pull rolls and the winding roll will increase, resulting in upwards vertical movement of the dancer roll 14. This movement is transmitted to the regulator 28 which acts to decrease the motor speed, lowering the tension in the web and returning the dancer roll to its former position. In a similar manner a decrease in motor speed will result in a downward movement of the dancer roll and a consequent increase in motor speed until the dancer roll returns to its former position. It is therefore apparent that with a constant web speed through the pull rolls, the dancer roll will always return to a constant equilibrium position, the actual position being dependent on the web speed through the pull rolls, the tension in the web as determined by the weight or loading of the dancer roll and other factors.

However, in actual winder operation, the winding roll continuously increases in diameter and therefore the rotational speed of core 18 must continuously decrease to maintin a constant web speed. Therefore, assuming a small increment of time, a constant motor speed will result, due to the increase in winding roll diameter, in an increase in web tension and an upward movement of the dancer roll. The regulator will then cause the motor to slow down until correct tension is restored. However, the dancer roll will not return to its original position but will assume a new higher equilibrium position corresponding to the lower motor speed. These steps occur continuously in very small increments so that from the start of winding on the core until a full roll is wound, the equilibrium position of the dancer roll changes smoothly from a lower position near "X" to a higher position near "Y".

At the time of transfer from the fully wound roll to the new core it is therefore necessary that the equilibrium position of the dancer roll be restored to the lower position corresponding to high motor speed. It is understood that the expressions "time of transfer" and "during transfer" as used herein refer to the period from the time, as set forth below, that the new core clutch 24 is engaged, through the actual moment of transfer, to the time that the equilibrium position of the dancer roll is restored. This movement must be accomplished relatively slowly and smoothly in order to avoid disturbances to the web and transient instability of the dancer roll system. In addition, a finite time is required to accelerate the winder drive motor from the slow speed corresponding to the full wound roll to the speed corresponding to the new core.

When a web transfer is to be made, new core clutch 22 is engaged, starting rotation of new core 17 at slow speed. The winder turret is then indexed so that the new core is brought to the transfer position as shown in the drawing. At this time the web 10 may be allowed to slip over the new core or may be held out of contact by means of a transfer device. The transfer device is not shown as it may be of any well known types that cut the traveling web and start the leading edge of the web around the new core. The transfer may also be made manually by an operator if no transfer device is provided. Auxiliary drive wheel 29 is now placed in contact with the new core 17 and brings up the peripheral speed of the new core to slightly less than the speed of the web, overrunning clutch 25 allowing the core speed to be greater than the rotational speed of pulley 22.

The transfer device is now actuated, cutting the web between the wound roll 18*a* and the new core 17 and wrapping and starting the leading edge of the web on new core 17. Clutch 26 is then disengaged, disconnecting core 18 and wound roll 18*a* from the drive motor. Since the peripheral speed of the new core is slightly less than the web speed coming from the pull rolls, the tension in the web will decrease and dancer roll 14 will slowly descend and consequently increase the speed of the winder drive motor through actuation of the regulator 28. This increase in speed will continue until the motor speed equals that corresponding to the core speed at which time overrunning clutch 25 will engage and the core is driven by the motor. The motor will continue to increase in speed until the core speed corresponds to the web speed coming from the pull rolls at which time the dancer roll will be restored to its lower equilibrium position. During this time the auxiliary drive wheel 29 is allowed to be overdriven by the core through the action of auxiliary drive overrunning clutch 30. The auxiliary drive wheel is then removed from contact with the core, the wound roll removed from the winder and a new core installed in preparation for the next transfer. It should be noted that the auxiliary drive wheel may be removed from contact with the core any time after the core speed corresponds to the web speed coming from the pull rolls. However, as the winding continues on the new core, the new core speed will decrease due to the increasing diameter of the winding roll and it is therefore necessary that the auxiliary drive wheel be removed from contact with the core before the core speed decreases to a speed corresponding to the auxiliary drive.

It can be seen that with the use of this invention the restoration of the equilibrium position of the dancer roll from its position at low winder drive motor speed corresponding to a fully wound roll to its position required for high winder speed corresponding to the new core is accomplished smoothly and without web disturbances or transient instability problems. It has been found that this restoration time is preferably in the range of 3 to 30 seconds although longer times may be necessary under certain conditions. This restoration time is determined by a number of factors including the web speed, the web tension, the distance that the dancer roll moves from its upper to its lower position, the inertia and damping of the dancer roll and, importantly, the difference between the new core speed as driven by the auxiliary core drive and the web speed; the smaller the speed difference the longer the restoration time. It has been found in practice that under usual conditions a new core speed in the range of 3 – 15 percent less than the web speed is satisfactory while the range of 5 – 10 percent is preferred.

The term core is used herein to denote not only a typical paper, plastic or metal tube on which web material is wound, but also includes winder shafts or mandrels upon which the web material is wound directly. Two winding positions are shown and described but the invention is not restricted to two but is also applicable to a winder with three or more winding positions.

The auxiliary drive to the core is shown and described herein as a friction drive from auxiliary drive wheel 29 to the surface of the core itself. This has the advantage that variations in the core diameter will have no effect on the surface speed of the core. Other means may be employed such as a friction belt running on the core, a friction belt or wheel running on a pulley on the core shaft, a gear or other type of direct drive to the core shaft or any other means known in the art. It is only required that whatever auxiliary drive means are used, the driven peripheral speed of the core will be slightly less than that of the corresponding web speed.

The drive to the auxiliary core drive is shown as coming from driven pull rolls 11 and 12. However, it is not necessary that this drive be taken from pull rolls or even that pull rolls are required, as the drive to the auxiliary core drive may be taken from any part of the supply source of the web material such as a processing machine, it being only necessary that such drive correspond in speed to the speed of the web leaving the processing machine.

As illustrated and described the dancer roll movement is substantially vertical with the web passing underneath the roll. However, other arrangements well known in the art, including, but not limited to, dancer rolls with horizontal movement, are satisfactory in the practice of this invention. It is understood that the terms "upper position" and "lower position" of the dancer roll as used herein refer to the dancer roll positions at which the drive motor is signaled to run at slow and high speeds respectively, regardless of the physical configuration of the dancer roll assembly.

I claim:

1. Winder apparatus for winding a continuously moving web of material delivered from a supply source and transferring the web from a first winding core to a second winding core comprising:

a rotatable winder turret supporting the first and second winding cores;

a dancer roll located between the supply source and the winder turret and capable of movement between upper and lower positions, in response to tension in the web;

a single drive motor responsive in speed to the position of the dancer roll;

winder drive means from the drive motor to the cores including a disconnect clutch and an overrunning clutch in the drive to each core, the overrunning clutch allowing free rotation of the cores in one direction;

an auxiliary core drive means to drive the second winding core during transfer of a peripheral speed slightly less than the web speed;

the auxiliary core drive means including an overrunning clutch effective to allow free rotation of the second winding core in one direction;

transfer means to transfer the web from a wound roll on the first winding core to the second winding core, and the winder drive means and the auxiliary core drive means cooperating to provide a smooth and controllable movement of the dancer roll from the upper position to the lower position during transfer of the web from the first winding core to the second winding core.

2. Winder apparatus as defined in claim 1 wherein the drive motor speed is slow in response to the upper position of the dancer roll and the speed increases with movement of the dancer roll towards the lower position.

3. Winder apparatus as defined in claim 1 wherein the auxiliary core drive drives the second winding core at a peripheral speed 3 to 15 percent less than the web speed.

4. Winder apparatus as defined in claim 1 wherein the auxiliary core drive drives the second winding core at a peripheral speed 5 to 15 percent less than the web speed.

5. The method of winding a continuously moving web of material delivered from a supply source and transferring the web from a first winder core to a second winder core wherein the cores are supported on a rotatable winder turret and both cores are driven by a single winder motor whose speed is responsive to dancer roll means whose position is responsive to the tension in the web, the transferring steps comprising:

driving the first core by means of the winder motor about its axis to wind the web onto the first core and form a wound roll;

rotating the turret to advance the second core to a transfer position;

connecting the winder motor to the second core to drive the second core through a first overrunning clutch;

increasing the speed of the second core to a peripheral speed slightly less than the speed of the web by means of an auxiliary core drive driving through a second overrunning clutch;

severing and transferring the web from wound roll to the second core;

disconnecting the drive from the winder motor to the first core, and continuing to drive the second core by means of the auxiliary core drive until the dancer roll means has reached an equilibrium position corresponding to control of the speed of the winder motor corresponding to the web speed as being wound on the second core.

6. The method of claim 5 wherein the auxiliary core drive drives the second core at a peripheral speed 3 to 15 percent less than the web speed.

7. The method of claim 5 wherein the auxiliary core drive drives the second core at a peripheral speed 5 to 15 percent less than the web speed.

* * * * *